United States Patent [19]

Glomm et al.

[11] 4,402,666

[45] Sep. 6, 1983

[54] FORCED DRAFT RADIANT WALL FUEL BURNER

[75] Inventors: Horst M. Glomm, Frankfurt am Main; Klaus E. Sawatzki, Niddatal; Dieter Fischer, Bischofsheim, all of Fed. Rep. of Germany

[73] Assignee: John Zink Company, Tulsa, Okla.

[21] Appl. No.: 214,589

[22] Filed: Dec. 9, 1980

[51] Int. Cl.[3] ..... F23C 5/08

[52] U.S. Cl. ..... 431/177; 431/187; 431/217; 431/284; 431/348; 239/424.5

[58] Field of Search ..... 431/162, 171, 175, 177, 431/217, 284, 347, 348, 181, 187; 239/424.5, 425

[56] References Cited

U.S. PATENT DOCUMENTS

| | | | |
|---|---|---|---|
| 370,251 | 9/1887 | Field | 431/162 |
| 1,779,647 | 10/1930 | Van Brunt . | |
| 3,123,127 | 3/1964 | Willott | 421/177 |
| 3,139,138 | 6/1964 | Bloom | 431/177 |
| 3,179,151 | 4/1965 | Reed | 158/1.5 |
| 3,180,393 | 4/1965 | Reed | 158/1.5 |
| 3,182,712 | 5/1965 | Zink et al. | 158/116 |
| 3,267,984 | 8/1966 | Reed et al. | 158/1.5 |
| 3,368,605 | 2/1968 | Reed | 158/7 |
| 3,416,735 | 12/1968 | Reed | 239/567 |
| 3,639,095 | 2/1972 | Zink | 431/177 |
| 3,663,153 | 5/1972 | Bagge et al. | 431/187 |
| 3,684,424 | 8/1972 | Zink et al. | 431/347 |
| 3,940,234 | 2/1976 | Reed et al. | 431/348 |
| 4,045,160 | 8/1977 | Michels | 431/347 |
| 4,257,762 | 3/1981 | Zink et al. | 431/348 |

FOREIGN PATENT DOCUMENTS

| | | | |
|---|---|---|---|
| 2536073 | 3/1976 | Fed. Rep. of Germany | 431/187 |
| 1060082 | 6/1959 | Netherlands . | |
| 1751491 | 12/1971 | Netherlands . | |
| 2150112 | 12/1977 | Netherlands . | |
| 1017910 | 8/1963 | United Kingdom . | |

*Primary Examiner*—James C. Yeung

*Attorney, Agent, or Firm*—Head, Johnson & Stevenson

[57] ABSTRACT

A forced draft, radiant wall, fuel burner, comprises a burner constructed with a central circular pipe for the conduction of pressurized combustion air, a second larger diameter pipe coaxial with the air pipe, with pressurized gas supplied to the closed annular space between the two pipes. The inner pipe extends forwardly beyond the end of the outer pipe. Fuel orifices are drilled in the forward end of the annular space, so that the gas flow will be parallel to the axis of the pipes. A second series of gas orifices are drilled through the outer wall of the second tube so that the gas glow is radial along the front of the burner tile. A plurality of air orifices are drilled radially in the forward end of the air pipe, so that the air flow is radial and directed perpendicularly against the principal longitudinal gas flow. The air tube spreads conically outwardly at its forward end. There are a plurality of longitudinal slots, for radial flow of air outwardly against a cylindrical wall which is part of a circular plate over the forward end of the air pipe. The flow of air from the slots deflected by the cylindrical wall, flows generally in a reverse direction against the flow of the gas from the end orifices. The two flows of air providing turbulent and complete mixing with the gas. The burning gas and flame then moves radially outwardly in a circular sheet along the front of the tile, to heat the tile to incandescence, so as to radiate heat to the heat receptive surfaces of the boiler.

6 Claims, 3 Drawing Figures

FORCED DRAFT RADIANT WALL FUEL BURNER

BACKGROUND OF THE INVENTION

1. FIELD OF THE INVENTION

This invention lies in the field of radiant wall gaseous fuel burners. More particularly, it is in the field of burners, in which air and gas meet substantially at right angles to provide intimate turbulent contact, for efficient, smokeless burning, and flow as a circular sheet radially outwardly against a tiled furnace wall, to provide radiant heat flow from the tile to any heat absorptive surfaces, such as they may be.

2. DESCRIPTION OF THE PRIOR ART

While there is considerable art on the use of radiant wall burners, we believe that there are no designs which provide as clearly as does this design the 90° flow of gas and air in order to promote turbulent mixing and efficient smokeless burning.

SUMMARY OF THE INVENTION

It is a principal object of this invention to provide a gaseous fuel burner in which the jets of gas issuing from the orifices flow at right angles to the principal air jets, and provide intimate mixing and change of direction, as a radial fan, parallel with the face of the furnace tile.

These and other objects are realized and the limitations of the prior art are overcome in this invention by providing a special burner configuration in which the principal burner tube is a circular cylindrical tube or pipe, through which air is supplied under pressure. The gas flows longitudinally in a closed annular space between the central first pipe and a second outer pipe. The two pipes are coaxial. Both pipes extend through the wall of the furnace. The burner is inserted through an opening in the tile portion of the furnace wall.

The gas flows longitudinally in the annulus between the inner and outer tubes toward the closed forward end of the annulus. There is a plurality of circumferentially spaced orifices in the front annular wall of the annular chamber, for the flow of gaseous fuel. There is also a plurality of smaller orifices, drilled radially through the wall of the outer tube, which extends in front of the tile wall of the furnace. Thus, there are two sets of gas flow jets. A major group of jets flow longitudinally, parallel to the outer surface of the air pipe and a smaller number of radial jets flow out substantially along the wall of the tile.

The inner, or air pipe, extends forward of the closure wall of the annular chamber. There is a plurality of radial openings drilled through the wall of the air tube, in front of the closure wall of the annular chamber. The air jets flowing radially out of these openings contact and mix in a very vigorous and turbulent manner, to provide complete intimate mixing of the air and gas, for complete and smokeless combustion.

The forward end of the air tube is expanded outwardly in a short conical fashion, and is closed with a circular plate which carries a shallow cylindrical wall around its circumference. Air flows through the first pipe, through a plurality of slots cut into the conical portion, and flows outwardly to the confining cylindrical wall, where it is diverted substantially in a rearward longitudinal flow, intersecting the gas jets in almost a 180° manner.

The results of the four sets of gas and air flows combine and mix in the area 71 very close to the front wall of the tile, and then flow radially outwardly along the tile, transferring, by contact of the flame on the tile, the heat of burning of the fuel.

The tile becomes incandescent as a result of this heating, and transfers its heat by radiation to any heat receptive surfaces, not shown, which are forward of the tile and in the furnace.

As this radial flow of burning gas and air spreads out as a transverse and circular body along the furnace-face of the tile, the gas jets directed radially outwardly, and flowing up along the front face of the tile are in a relatively quiescent space, so they burn very stably to provide continuing reignition of the main gas-air flow if instability should exist in that principal flow.

The air flow is pressurized by means such as blower 39, so as to provide high velocity jets of air. Similarly, the gas is supplied at a high enough pressure so that there are high velocity jets of gas 64 and 70 issuing from the orifices. The air is provided as a source of oxygen to mix with the fuel gas for burning. Because of the 90° and 180° angular relations between the gas jets and the air jets, there is a high degree of air/fuel mixture, which is extremely turbulent, and provides the best opportunity for complete and smokeless burning of the fuel.

An important feature of the design is, of course, the confluence of two sets of high velocity jets one of gas and one of air at right angles to each other. There is also a second confluence of high velocity gas jets and air jets moving substantially in opposite directions, to turbulently mix.

In order to enhance heat dispersion in a generally forward direction, there is a plurality of forwardly sloping radial ribs on the front face of the tile, extending radially-outwardly around the burner. Such ribs are provided for better heat transfer contact with the radially outwardly moving fan of burning gas. Thus, the forward looking surface of the ramp is heated by the moving flame, to greater advantage than the adjacent flat plane surfaces, for selective enhancement of surface radiation in the rib surface areas without significant forward movement of the flame.

Selective control of air and gas volumes for the most efficient gas fuel burning conditions is not shown. However, in commercial applications such control for either manual or automatic operation, on a continuing basis is by well known means in the present day art.

BRIEF DESCRIPTION OF THE DRAWINGS

These and other objects and advantages of this invention, and a better understanding of the principles and details of the invention will be evident from the following description taken in conjunction with the appended drawings, in which.

DETAILED DESCRIPTION OF THE PREFERRED EMBODIMENTS

Figure 1:
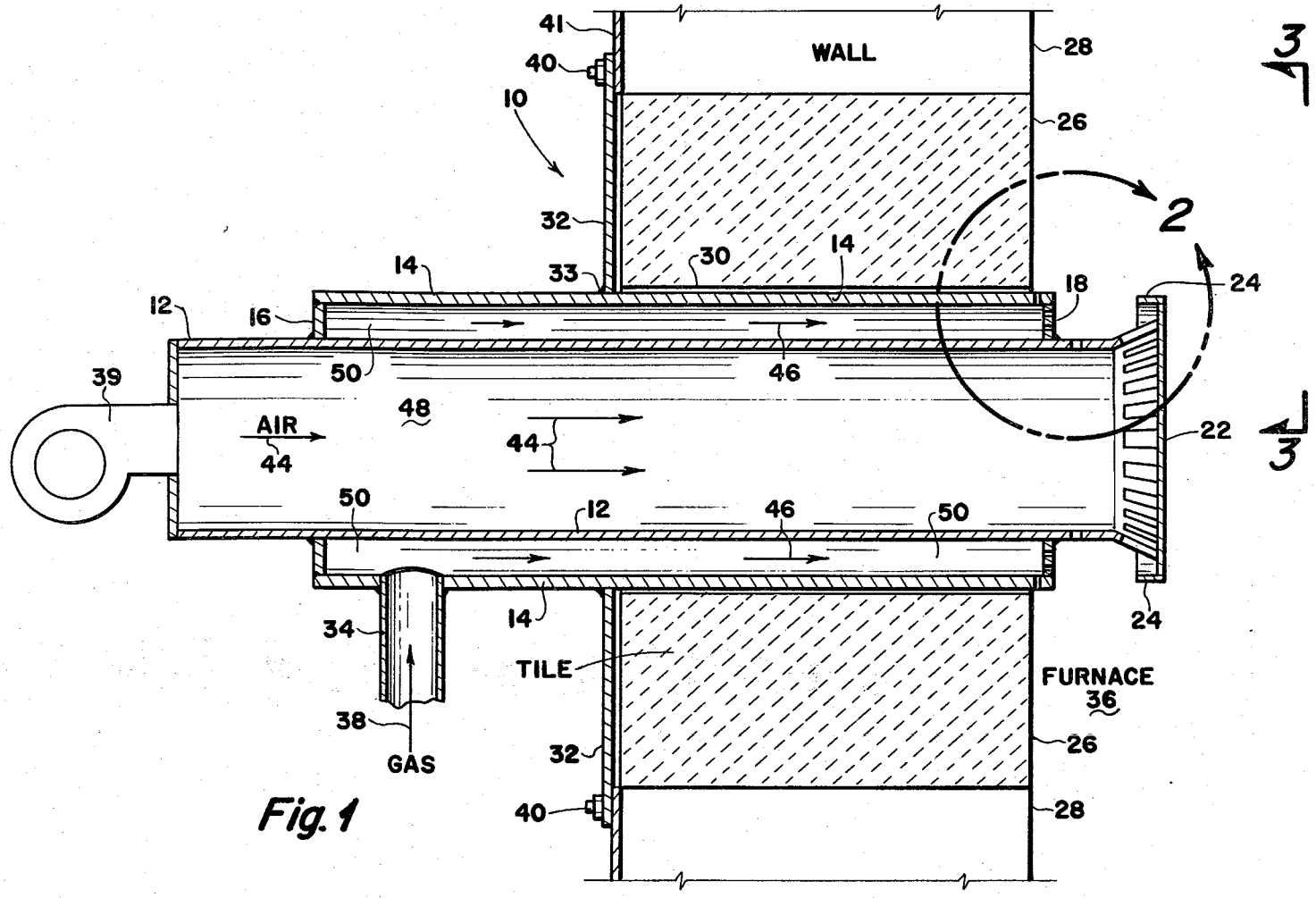
FIG. 1 illustrates a vertical cross-section through the axis of the burner.

Referring now to the drawings, there is shown a vertical cross-section of one embodiment of the invention indicated generally by the numeral 10. It comprises a first inner pipe 12, through which combustion air flows under pressure, such as from a blower shown schematically as 39, for example, in a direction indicated by arrows 44. There is a second outer pipe 14 coaxial to the inner pipe 12, which forms an annular space 50, closed by two annular plates 16 at the back end, and 18 at the front end.

The second tube is welded 33 to a perpendicular plate 32 surrounding the outer pipe 14. The plate 32 is adapted to be fastened by means such as bolts 40 to the outer metal covering 41 of the front wall of the furnace space 36.

There is a tile 26, which is inserted into the furnace wall. There is an opening 30 through the tile, through which the burner is inserted into the furnace. A portion of the front wall 28 of the furnace 36 is shown. The remainder of the furnace is not shown because this is conventional and well known in the art, and need not be described further.

Gas is supplied 38 through a side pipe 34 to the annular space 50, and flows through the annular space 50 longitudinally in accordance with arrows 46, to the forward end of the burner.

The outer pipe of the burner extends for a short distance in front of the front wall 26 of the tile. The inner air pipe 12 extends forwardly of the front end plate 18 of the outer pipe.

Figure 2:
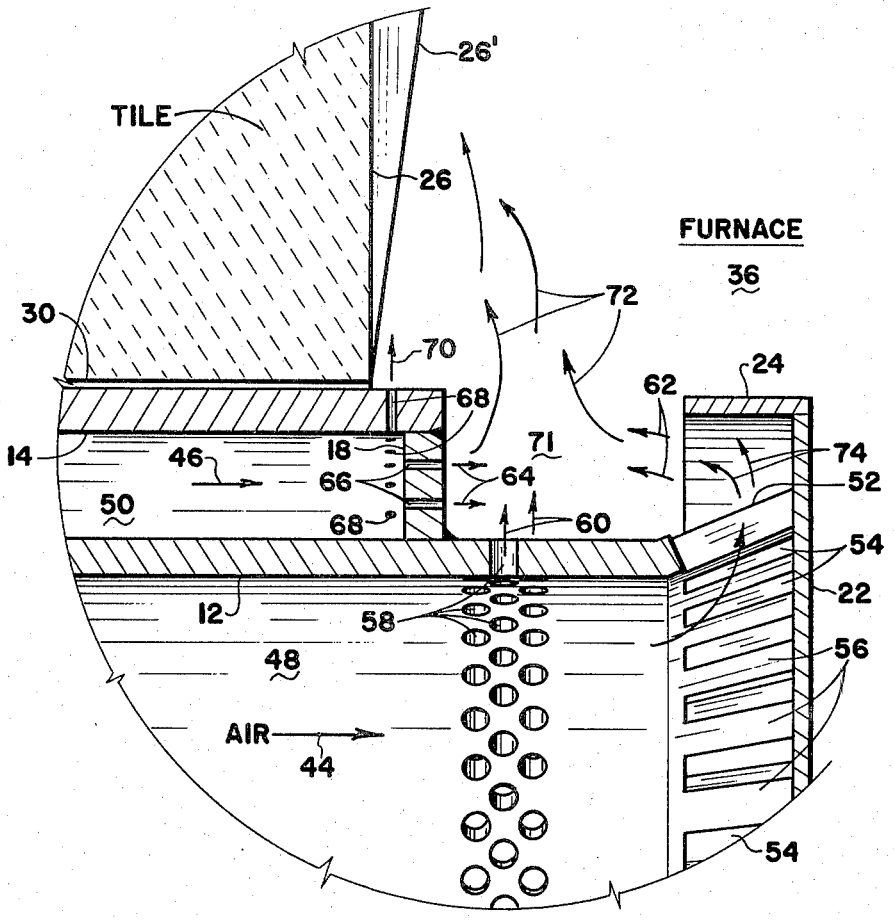
FIG. 2 illustrates to an enlarged scale the details of the burner orifices and gas flows, enclosed in the circle 2 of FIG. 1.

As shown in greater detail in FIG. 2 there is a plurality of longitudinal orifices 66 drilled in the forward wall 18 of the annular space 50, for the flow of pressurized gas in the form of high velocity jets 64, in a longitudinal manner along the outer wall of the air pipe 12.

A plurality of circumferentially-spaced radially-drilled openings 58 are drilled through the wall of the air pipe 12 slightly forward of the front plate 18 of the annular plate 18. Pressurized air is forced to flow in the form of high velocity jets 60, in a radial fan, perpendicular to the axis of the air pipe 12, in the plane of the openings 58.

These air jets 60 meet the high velocity gas jets 64 at 90°, to form a very turbulent mixing area in the space 71, to get maxiumum mixing of the gas and air, so that the fuel will be burned in an efficient, complete and smokefree manner.

The forward end of the air pipe 12 is expanded in the form of a cone 52, and is closed off at the front end by a circular plate 22, which extends radially outwardly from the air pipe to a selected diameter. The circular plate 20 has a short cylindrical pipe 24 welded along its outer circumference to form a baffle.

There is a plurality of slots 54 cut into the conical portion 52 of the front end of the air tube 12 so that air will flow through these slots in accordance with arrows 74, in a somewhat radial direction, and they will strike against the inner surface of the flange baffle 24, and be deflected substantially in the direction of arrows 62, which are going in a direction substantially in opposition to the gas jets 64. Here again, there is provided a very turbulent mixing of the second flow 62 of combustion air, into the mixture of gas and air provided in the space 71. This intimate turbulent mixing provides a maximum efficiency of combustion. The flame flows radially outward in a fan in accordance with arrows 72 to impinge upon the front face of the tile 26.

Figure 3:
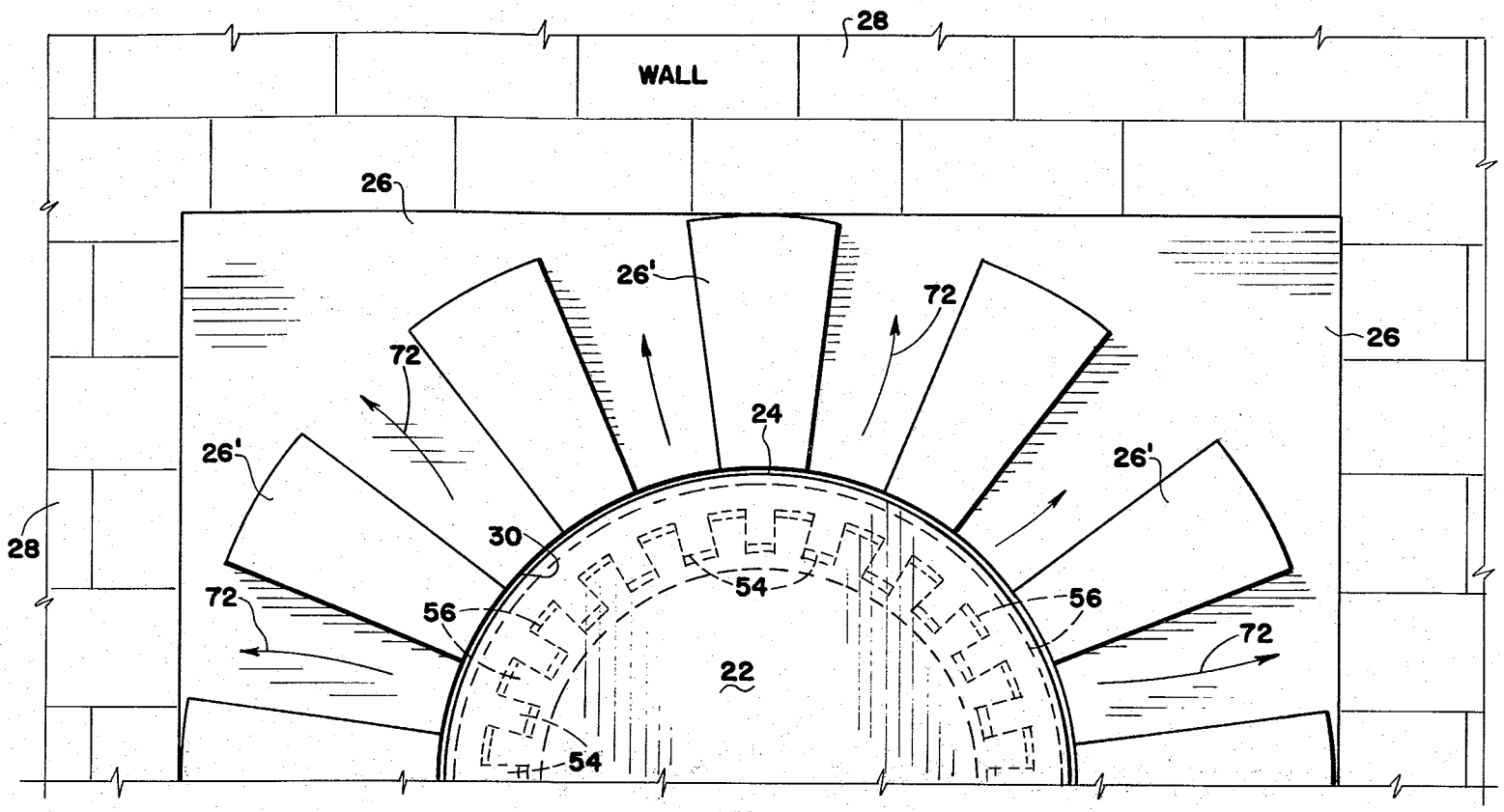
FIG. 3 is a partial view of the radiant wall tile as taken along the line 3—3 of FIG. 1.

For further improvement, and as shown in FIG. 3, of contact of the flame with the tile, which is desired, the tile may be provided with a plurality of sloping ridges 26' on the front face 26 of the tile, radiating out from the opening 30. The ribs 26' slope forwardly, providing better contact with the flame, and consequently providing a more complete heat transfer from the flame to the tile. In this way the ridges can reach a maximum temperature for efficient transfer of radiant energy to the heat receptive surfaces of the furnace.

There is also a plurality of smaller radial orifices 68 drilled circumferentially, through the outer pipe 14 close to and in front of the tile 26 to form a series of radial jets of gas 70. The rapidly outwardly and rearwardly flowing fan of flame 72 along the front face of the tile 26, provides a quiescent space between the flame and the tile through which the gas jets 70 flow. Thus, the flame provided by the gas jets 70 is extremely stable, and serves as a continuing reignition flame, in case the combustion of the major gas supply and air supply is unstable.

What has been described is a type of burner which provides a radial fan of flame to contact and heat the forward face of the tile so as to efficiently radiate heat to the heat absorbing surfaces. This flame is provided by the junction of two series of jets, a first plurality of jets of fuel moving longitudinally to the axis of the burner and a plurality of air jets moving radially outwardly, to intersect at right angles, and turbulently mix, for efficient burning.

There is also an additional supply of combustion air which moves to the forward end of the air pipe, and is deflected backwardly by a flange 24 to move in a direction essentially 180° from the direction of the gas jets, which again provides turbulent mixing. The 90° intersection of the air and gas jets and the 180° intersection of the gas and air jets provides a very well-mixed fuel and air flow which burns stably, completely, efficiently, and without smoke.

As regards the number and size of the longitudinal jets 64 and radial jets 70, the largest part of the gas supply will go into the longitudinal jets to mix directly with the air jets. Thus, there will be more orifices 66 and 68, and they will be larger than 68. Of course, the final number and size of the orifices is determined by amount of heat to be generated, and the allowable pressure drop for the combustion air. Slot width may vary from 1 to 3 mm or more.

This burner design is adaptable to be operated with a pressurized combustion chamber.

While the invention has been described with a certain degree of particularity, It is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element or step thereof is entitled.

What is claimed is:

1. A forced draft, gaseous fuel burner for a radiant-walled furnace space, comprising:

(a) an inner air pipe for the flow of combustion air, having a forward end inserted into the furnace space;

(b) an outer coaxial pipe, supported to the furnace wall and to said inner pipe by a rearward wall and a forward wall to form a closed annular chamber, with its forward end inserted a selected short distance into the furnace space;

means to supply gaseous fuel to the annular chamber;

(c) the forward end of the inner pipe extending forwardly beyond the front end of the outer coaxial pipe, and flared out in a conical form, a plurality of circumferentially-spaced slots in the flared out portion; the front of the inner pipe closed with a circular plate larger in diameter than the end of the flared-out portion; a rearwardly-directed cylindrical wall whereby the air flowing from the slots is directed rearwardly for greater gas-air turbulent mixing;

(d) a first plurality of circumferentially spaced orifices drilled longitudinally in said forward wall of the annular chamber; and a second plurality of orifices drilled radially at the forward end of the outer pipe;

(e) a third plurality of radial orifices drilled in the wall of the inner pipe between the forward end of said annular chamber and the flared-out portion of the inner pipe.

2. The apparatus as in claim 1 including means to supply pressurized air to the inner pipe.

3. The apparatus as in claim 1 in which heat radiating tile forms part of the inner wall of said furnace space, and including a plurality of sloping radial ribs, the sloping surfaces of said ribs lying along a conical surface extending forwardly into said flame to provide better flame contact with said tile.

4. A forced draft, gaseous fuel burner for a radiant-walled furnace space, comprising:

(a) an inner air pipe for the flow of combustion air, having a downstream end inserted into the furnce space;

(b) an outer coaxial pipe, supported to the furnace wall and to said inner pipe by a rearward wall and a forward wall to form a closed annular chamber, with its downstream end inserted a selected short distance into the furnace space;

means to supply gaseous fuel to the annular chamber;

(c) the downstream end of the inner pipe extending beyond the downstream end of the outer coaxial pipe, and flared out in a conical form, a plurality of circumferentially-spaced slots in the flared-out portion; the front of the inner pipe closed with a circular plate larger in diameter than the end of the flared-out portion whereby the air will reverse its flow in a generally upstream direction; a rearwardly-directed cylindrical wall whereby the air flowing from the slots is directed rearwardly for greater gas-air turbulent mixing; and (d) a plurality of circumferentially-spaced orifices drilled longitudinally in said forward wall of the annular chamber whereby the gaseous fuel is directed downstream into contact with the upstream directed air, and whereby the resultant ignited flame will move radially outwardly against the radiant wall.

5. A forced draft, gaseous fuel burner for a radiant-walled furnace space, comprising:

(a) an inner air pipe for the flow of combustion air, having a downstream end inserted into the furnace space;

(b) an outer coaxial pipe, supported to the furnace wall and to said inner pipe to form a closed annular chamber, with its downstream end inserted a selected short distance into the furnace space; means to supply gaseous fuel to the annular chamber.

(c) the downstream end of the inner pipe extending beyond the downstream end of the outer coaxial pipe, and flared out in conical form, a plurality of circumferentially-spaced slots in the flared-out portion; the front of the inner pipe closed with a circular plate larger in diameter than the end of the flared-out portion whereby the air will reverse its flow in a generally upstream direction; a rearwardly-directed cylindrical wall whereby the air flowing from the slots is directed rearwardly for greater gas-air turbulent mixing; and (d) a plurality of radial orifices drilled in the wall of the inner pipe between the downstream end of the annular chamber and the flared-out portion of the inner pipe, whereby the gasous fuel will flow downstream into contact with the upstream directed air, and whereby the resultant ignited flame will move radially outwardly against the radiant wall.

6. The burner of claim 4 or 5 including a plurality of orifices drilled radially at the forward end of the outer pipe.

* * * * *